US011095962B2

(12) United States Patent
Francke et al.

(10) Patent No.: US 11,095,962 B2
(45) Date of Patent: Aug. 17, 2021

(54) PRINTING DEVICE WITH SPEAKER

(71) Applicants: Hewlett-Packard Development Company, L.P., Spring, TX (US); Justin Francke, San Diego, CA (US); Ernesto Villalobos, San Diego, CA (US); Joedy Zou, Shanghai (CN); Wan Ying Wang, Shanghai (CN)

(72) Inventors: Justin Francke, San Diego, CA (US); Ernesto Villalobos, San Diego, CA (US); Joedy Zou, Shanghai (CN); Wan Ying Wang, Shanghai (CN)

(73) Assignee: Hewlett-Packard Development Company, L.P., Spring, TX (US)

( * ) Notice: Subject to any disclaimer, the term of this patent is extended or adjusted under 35 U.S.C. 154(b) by 64 days.

(21) Appl. No.: 16/495,709

(22) PCT Filed: Mar. 30, 2017

(86) PCT No.: PCT/CN2017/078773
§ 371 (c)(1),
(2) Date: Sep. 19, 2019

(87) PCT Pub. No.: WO2018/176316
PCT Pub. Date: Oct. 4, 2018

(65) Prior Publication Data

US 2020/0100005 A1 Mar. 26, 2020

(51) Int. Cl.
*H04R 1/02* (2006.01)
*B41J 29/13* (2006.01)

(52) U.S. Cl.
CPC ..... *H04R 1/025* (2013.01); *B41J 29/13* (2013.01); *H04R 2420/07* (2013.01)

(58) Field of Classification Search
CPC . B41J 3/36; B41J 29/393; B41J 29/13; H04R 1/025; H04R 2420/07
See application file for complete search history.

(56) References Cited

U.S. PATENT DOCUMENTS 6,182,565 B1 2/2001 Takayama et al.
7,511,846 B2 3/2009 Hart et al.
(Continued)

FOREIGN PATENT DOCUMENTS

CN 1655141 A 8/2005
CN 1668473 A 9/2005
(Continued)

OTHER PUBLICATIONS

IOS Android Printer Kitchen POS Wi-fi Printer Wall Mural Printer—Dec. 2016—11 pages—https://www.alibaba.com/.
(Continued)

*Primary Examiner* — Jannelle M Lebron
(74) *Attorney, Agent, or Firm* — Brooks Cameron & Huebsch LLP

(57) ABSTRACT

A printing device (100) with speakers is disclosed. The printing device (100) comprises a wireless speaker (102) positioned between a load tray (104) and an output tray (106), a first user interface (108) positioned on a first edge of the wireless speaker (102) to receive inputs for the printing device (100), and a second user interface (110) positioned on a second edge of the wireless speaker (102) to receive inputs for the wireless speaker.

15 Claims, 4 Drawing Sheets

(56) References Cited

U.S. PATENT DOCUMENTS

| | | | | |
|---|---|---|---|---|
| 2007/0135047 | A1 | 6/2007 | Lee | |
| 2008/0065379 | A1 | 3/2008 | Evans et al. | |
| 2009/0021797 | A1 * | 1/2009 | Luciano ..... | H04N 1/00241 358/474 |

FOREIGN PATENT DOCUMENTS

| | | | |
|---|---|---|---|
| JP | 2003140878 | A | 5/2003 |
| JP | 2005094109 | A | 4/2005 |
| KR | 20010026172 | A1 | 4/2001 |
| KR | 20020070744 | A | 9/2002 |

OTHER PUBLICATIONS

Star AsuraCPRNT Interactive Platform Printer, http://www.touchwindow.com/—Dec. 2016—2 pages.
Transaction Terminals with Printer, < http://stesalitsystems.com/—2016/2017—3 pages.
Wellington, T., Samsung Announces Printer with Built-in Music Speakers, Aug. 29, 2013, < http://www.macgasm.net/2013/08/29/samsung—3 pages.

* cited by examiner

PRINTING DEVICE WITH SPEAKER

BACKGROUND

Printers can be peripheral devices for computing devices to generate images on print media. For example, printers can be utilized to generate a copy of images on paper media from an image displayed on a computing device display. In some examples, printers can be connected to a computing device and generate images displayed on the computing device on to the print media utilizing a number of methods. In some examples, printers can be inkjet printers or laser printers. Inkjet printers can deposit printing fluid on the print media to generate the image. Laser printers can repeatedly pass a laser over a negatively charged cylinder that can deposit toner on the print media to generate an image.

DETAILED DESCRIPTION

Figure 1:
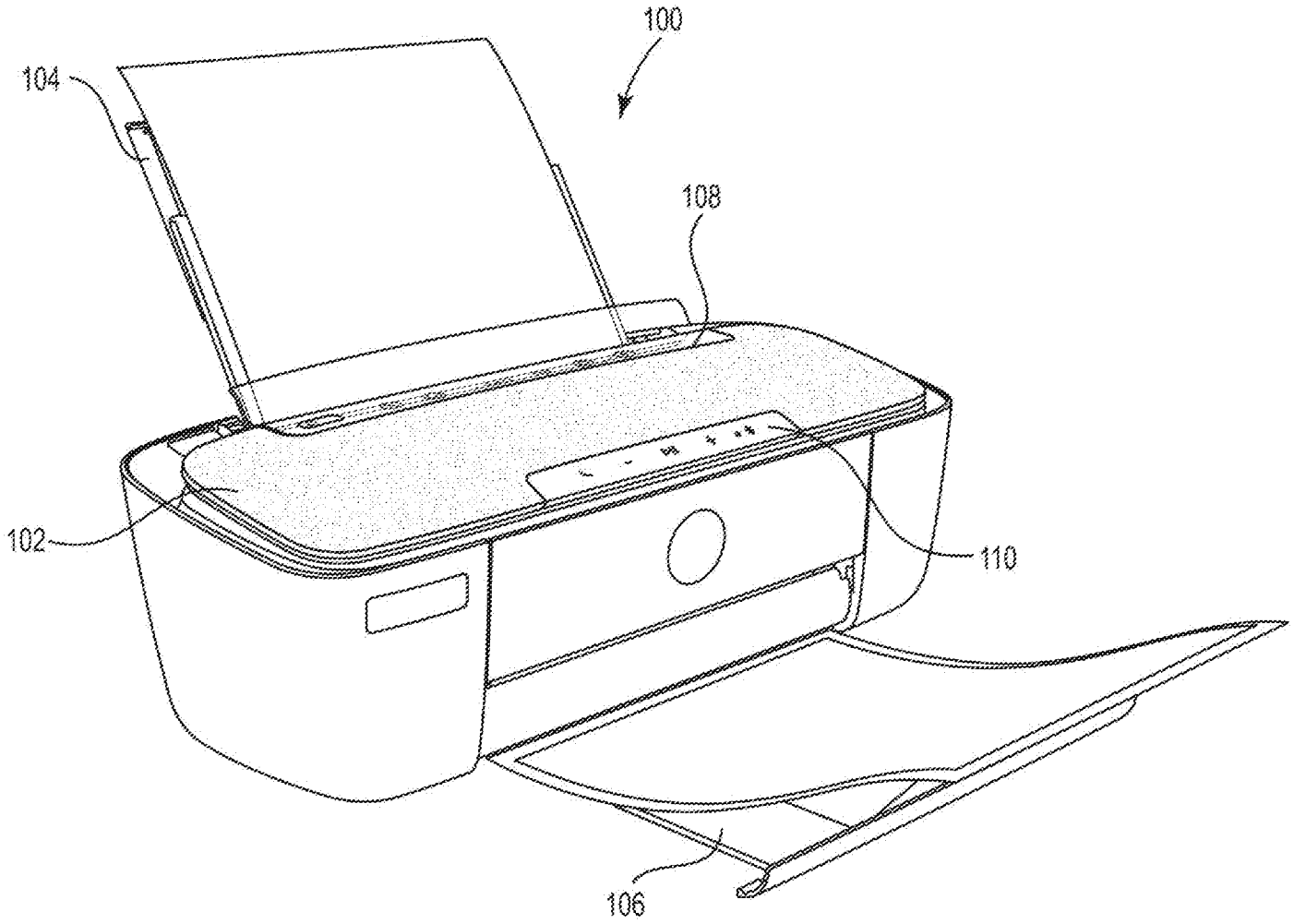
FIG. 1 illustrates an example of a printing device consistent with the present disclosure.

A number of systems and devices for a printing device with a speaker are described herein. In some examples, a printing device with a speaker can include a printing device, comprising a wireless speaker positioned between a load tray and an output tray, a first user interface positioned on a first edge of the wireless speaker to receive inputs for the printing device, and a second user interface positioned on a second edge of the wireless speaker to receive inputs for the wireless speaker. As used herein, a wireless speaker is a device that includes an electroacoustic transducer that convert electrical audio signal into sound that also includes a wireless communication module. As used herein, the wireless communication module includes hardware to transmit and/or receive wireless communication signals.

The printing device with a speaker described herein can provide a single device that is capable of functioning as a printer and an audio device simultaneously. These devices can provide extra functionality within the same footprint to lower a usage of space compared to having two separate devices. For example, a home office or student dorm room can be a relatively smaller space that can utilize the printing device with a speaker to lower the usage of space while maintaining the functionality described herein. That is, the speaker can be positioned within a footprint of the printing device.

The printing device with a speaker (e.g., wireless speaker) described herein can include a speaker with a plurality of user interfaces. In some examples, the plurality of user interfaces can each have a functionality that is specific to the printing device or the speaker. For example, the speaker can include a first user interface that can be utilized for the printing device and a second user interface that can be utilized for the speaker. In this example, the first user interface can display status notifications for the printing device and include input devices for the printing device. In addition, the second user interface can display status notifications for the speaker and include input devices for the speaker.

In some examples, the speaker can be positioned between a load tray (e.g., exterior media load tray, etc.) and an output tray (e.g., exterior media output tray, etc.) of the printing device. For example, the load tray can be positioned near a first edge of the speaker and the output tray can be positioned near a second edge of the speaker. In some examples, the speaker can be positioned above a print zone of the printer. As used herein, the print zone of the printer can be a location where the printing device generates an image on the print media. In addition, a print media pathway of the printing device can be positioned below the speaker.

In some examples, the speaker can be positioned within the footprint of the printing device. For example, the footprint of the printing device is not extended by a physical size of the speaker. Thus, the printing device with a speaker as described herein can provide a combination of functionality that can be beneficial for areas with limited space.

The figures herein follow a numbering convention in which the first digit corresponds to the drawing figure number and the remaining digits identify an element or component in the drawing. Elements shown in the various figures herein may be capable of being added, exchanged, and/or eliminated so as to provide a number of additional examples of the present disclosure. In addition, the proportion and the relative scale of the elements provided in the figures are intended to illustrate the examples of the present disclosure, and should not be taken in a limiting sense.

FIG. 1 illustrates an example of a printing device 100 consistent with the present disclosure. The printing device 100 can be an example of a printer, such as an inkjet or laser jet printer. The printing device 100 can include a load tray 104 (e.g., exterior media load tray, etc.). For example, the printing device 100 can include a load tray 104 for inserting print media (e.g., paper, plastic, etc.) to be printed by a print zone of the printing device 100. The printing device 100 can include an output tray 106 (e.g., exterior media output tray, etc.). For example, the printing device 100 can include an output tray 106 to receive and/or store print media that includes a generated image from the print zone of the printing device 100. In some examples, the print zone of the printing device 100 can be positioned below a speaker 102 (e.g., wireless speaker, etc.).

In some examples, the printing device 100 can include a speaker 102 that can be positioned between the load tray 104 and the output tray 106 of the printing device 100. In some examples, the speaker 102 can be positioned over a print zone of the printing device 100. For example, the speaker 102 can be positioned above the print zone and/or above a printing path of the printing device 100. In some examples, the speaker 102 can extend from a first end (e.g., left side of FIG. 1) of the printing device 100 to a second end (e.g., right side of FIG. 1) of the printing device 100.

In some examples, the speaker 102 can include a first user interface 108. The first user interface 108 can be coupled to a first edge of the speaker 102. In some examples, the first user interface 108 can be positioned between the load tray 104 and the speaker 102. In some examples, the first user interface 108 can be communicatively coupled to the printing device 100. For example, the printing device 100 can include a computing device to provide functionality for the printing device. In this example, the computing device of the printing device can receive communication signals from a remote device. In this example, the communication signals can describe an image to be generated by the printing device 100.

In some examples, the first user interface 108 can include a number of inputs and/or a number of notifications that correspond to functionality of the printing device 100. In some examples, the first user interface 108 can be utilized to alter settings of the printing device 100. For example, the first user interface 108 can include inputs for canceling print jobs, feeding print media, activating the printing device 100 and/or deactivating the printing device 100. In some examples, the first user interface 108 can include notification displays to notify a user based on a status of the printing device 100. For example, the first user interface 108 can include notification displays for network connection status and/or feeding errors associated with the printing device 100.

In some examples, the speaker 102 can include a second user interface 110. In some examples, the second user interface 110 can be coupled to a second edge of the speaker 102. In some examples, the second user interface 110 can be positioned between the output tray and the speaker 102. In some examples, the second user interface 110 can be communicatively coupled to the speaker 102. For example, the speaker 102 can include a computing device to provide functionality for the speaker 102. In this example, the computing device of the speaker can receive communication signals from a remote device. In this example, the communication signals can alter settings of the speaker 102. Thus, the second user interface 110 can be coupled to a second edge of the speaker 102, wherein the second user interface 110 is communicatively coupled to the wireless speaker 102 to alter settings of the wireless speaker 102 and initiate communication with a remote computing device (e.g., initiate a wireless connection, initiate a telephone call, etc.).

In some examples, the second user interface 110 can include a number of inputs and/or a number of notifications that correspond to functionality of the speaker 102. For example, the second user interface 110 can include inputs for initiating a communication session with a remote device, playing audio media from a remote device, increasing volume of the speaker 102, decreasing volume of the speaker 102, initiating a telephone call via a remote device, and/or providing other functionality of the speaker 102. In some examples, the second user interface 110 can include notification displays to notify a user based on a status of the speaker 102. For example, the second user interface 110 can include notification displays for a communication session with a remote device, a call status via a remote device, and/or other notifications associated with the speaker 102.

The printing device 100 can be utilized to generate images on print media and provide a wireless speaker for a remote device. In some examples, the printing device 100 can provide a relatively smaller footprint for areas with limited space. In addition, the printing device 100 can provide a plurality of user interfaces for each function of the printing device 100 to more easily access inputs or notifications for a particular function.

Figure 2:
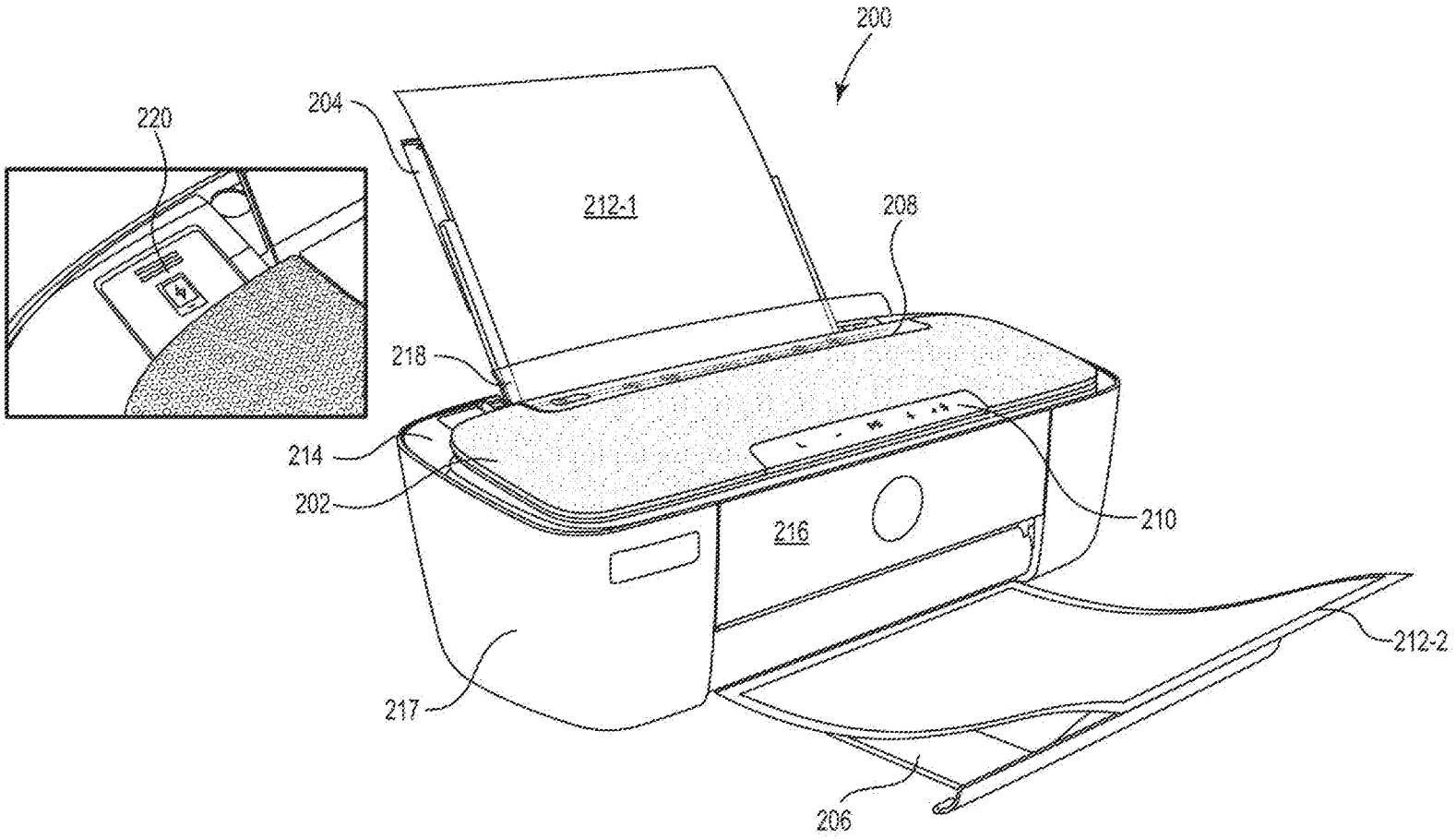
FIG. 2 illustrates an example of a printing device consistent with the present disclosure.

FIG. 2 illustrates an example of a printing device 200 consistent with the present disclosure. In some examples, the printing device 200 can include the same or similar features as printing device 100 as referenced in FIG. 1. For example, the printing device 200 can include a load tray 204 and an output tray 206. In some examples, the printing device 200 can include a speaker 202. As described herein, the speaker 202 can be a wireless speaker that can wirelessly connect to a remote device. For example, the speaker 202 can be a wireless speaker with Bluetooth® capabilities. In this example, the speaker 202 can initiate a wireless connection with a smart phone or other mobile computing device.

In some examples, the load tray 204 can include a media load tray that can be utilized to receive print media 212-1 to be utilized by the printing device 200. For example, a plurality of sheets of print media 212-1 can be positioned within the load tray 204. In this example, the printing device 200 can include a number of rollers or other type of feeding device to feed the print media 212-1 from the load tray 204 through a printing path to a print zone of the printing device 200. As used herein, the printing path includes a pathway for print media that directs the print media from the load tray 204 to the output tray 206.

In some examples, a print zone can be positioned within the printing path. That is, the printing pathway can be utilized to deliver the print media 212-1 to the print zone of the printing device 200. As used herein, the print zone of the printing device 200 is an area where an image is generated on the print media 212-1. For example, an inkjet printing device can deposit printing fluid on the print media 212-1 to generate an image on the print media 212-1. In some examples, the output tray 206 can be utilized to receive printed media 212-2. As used herein, printed media 212-2 includes print media with a generated image from the printing device 100.

In some examples, the printing device 200 can include a speaker 202 that is coupled between the input tray 204 and the output tray 206. For example, as illustrated in FIG. 2, the input tray 204 can be positioned on a left side of the speaker 202 and the output tray 206 can be positioned on a right side of the speaker 202. In some examples, the input tray 204 can be positioned on a first side or edge of the speaker 202 and the output tray 206 can be positioned on a second side or edge of the speaker 202.

In some examples, the speaker 202 can include a first user interface 208 coupled to a first edge or side of the speaker 202. As described herein, the first user interface 208 can be communicatively coupled to the printing device 200. In some examples, the first user interface 208 can include a number of inputs and/or a number of notifications corresponding to a functionality of the printing device 200. For example, the first user interface 208 can include, but is not limited to, paper jam notifications, network connectivity notifications, print job status notifications, paper feed inputs, power on inputs, power off inputs, among other notifications and inputs that correspond to a functionality of the printing device 200.

In some examples, the first user interface 208 can extend along a first edge or side of the speaker 202. In some examples, the first user interface 208 can be positioned between the input tray 204 and the speaker 202. For example, the input tray 204 can be positioned on a first side of the first user interface 208 and the speaker 202 can be positioned on a second side of the first user interface 208. In some examples, the first user interface 208 can include notifications and/or inputs exclusively for the printing device 200. For example, the first user interface 208 may not be communicatively coupled to the speaker 202. In this example, the first user interface 208 can still be physically coupled to the speaker 202 without having communication with the speaker 202. That is, the first user interface 208 may not be capable of providing notifications or inputs for the speaker 202 or a remote device communicatively coupled to the speaker 202.

In some examples, the speaker 202 can include a second user interface 210. The second user interface 210 can be communicatively coupled to the speaker 202 and physically coupled to the speaker 202. In some examples, the second user interface 210 can include a number of inputs and/or a number of notifications corresponding to a functionality of the speaker 202. For example, the second user interface 210 can include, but is not limited to, wireless connection notifications, audio control notifications, audio control inputs, telephone call inputs, conference call inputs, among other notifications and inputs that correspond to a functionality of the speaker 202. For example, the second user interface 210 can include inputs to initiate a wireless connection with a mobile computing device. In this example, the speaker 202 can: play audio files from the mobile computing device, enable a telephone call to be conducted through the speaker 202 and microphone of the speaker 202, and/or other functions that can be conducted through a wireless connection.

In some examples, the second user interface 210 can extend along a second edge or side of the speaker 202. In some examples, the second user interface 210 can be positioned between the output tray 206 and the speaker 202. For example, the output tray 206 can be positioned on a first side of the second user interface 210 and the speaker 202 can be positioned on a second side of the second user interface 210. In some examples, the second user interface 210 can include notifications and/or inputs exclusively for the speaker 202. For example, the second user interface 210 may not be communicatively coupled to the printing device 200. In this example, the second user interface 210 can still be physically coupled to the speaker 202 without having communication with the printing device. That is, the second user interface 210 may not be capable of providing notifications or inputs for the printing device 200 or a device communicatively coupled to the printing device 200.

In some examples, the first user interface 208, the speaker 202, and the second user interface 210 can be on the same plane. For example, the first user interface 208 can be on the same plane as the speaker 202 and the second user interface 210. That is, in some examples, the speaker 202, the first user interface 208, and the second user interface 210 can be positioned on a single plane of the printing device 100. In some examples, the first user interface 208, the speaker 202, and the second user interface 210 can be a single device with an enclosure (e.g., speaker enclosure, etc.). For example, the first user interface 208 and the second user interface 210 are non-removable devices from the speaker 202. In some examples, the speaker 202 can include an enclosure that is separate from the enclosure 217 of the printing device 200. In some examples, the first user interface 208 can be substantially parallel to the second user interface 210. For example, the first user interface 208 can extend along a first linear path within a particular plane. In this example, the second user interface 210 can extend along a second linear path with the particular plane. In this example, the first linear path can be substantially parallel to the second linear path. As used herein, substantially parallel includes elements that are parallel and/or elements that are more parallel than perpendicular.

In some examples, the printing device 200 can include an enclosure 217. The enclosure 217 can be utilized to physically protect the internals of the printing device 200. For example, the enclosure 217 can encase or enclose the printing path and/or print zone of the printing device 200 to protect the devices that make up the printing path and/or print zone. In some examples, the enclosure 217 can comprise a particular material that allows the enclosure 217 to protect the internals of the printing device 200. For example, the enclosure 217 can comprise a polymer material (e.g., plastic, etc.), a metallic material, or a combination thereof. In some examples, the enclosure 217 can include a gate 216 that can be opened to reveal the internals of the printing device 200. For example, the gate 216 can be opened to reveal print cartridges or other devices that may need repair or replacement.

In some examples, the enclosure 217 can include a recessed portion 214. The recessed portion 214 can be utilized for coupling or mounting the speaker 202. For example, the speaker 202 can be positioned within the recessed portion 214. In some examples, the recessed portion 214 can comprise a particular material that is the same or similar as the material of the enclosure 217. However, in other examples, the recessed portion 214 can comprise a particular material that is different than the material of the enclosure 217. That is, the enclosure 217 can comprise a first material and the recessed portion 214 can comprise a second material. In this example, the material of the recessed portion 214 can have different properties compared to the material of the enclosure 217. In some examples, the material of the recessed portion 214 can comprise a different finish compared to the finish of the material of the enclosure 217. For example, the finish of the enclosure 217 can comprise a matte finish and the finish of the recessed portion can comprise a gloss finish.

In some examples, a space between an edge of the recessed portion 214 and the speaker 202 can exist. For example, when the speaker 202 is coupled within the recessed portion 214, the speaker 202 may not extend to the edge of the recessed portion and thus expose a portion of the recessed portion 214 surrounding the speaker 202. In some examples, the recessed portion 214 can be utilized to provide an appearance that the speaker 202 is floating.

In some examples, the printing device 200 can include a charging port 220. In some examples, the charging port 220 can be positioned within an exposed portion of the recessed portion 214. For example, the charging port 220 can be positioned between the speaker 202 and an edge of the recessed portion 214 and/or enclosure 217. In some examples, the charging port 220 can include a dust cover or door that can protect the charging port 220 when it is not in use. In some examples, the charging port 220 can be a universal serial bus (USB) port. In some examples, the charging port 220 does not permit data transfers between a connected device and the printing device 200. In some examples, the charging port 220 does not permit data transfers between a connected device and the speaker 202.

In some examples, the printing device 200 can include a shield 218 coupled to the input tray 204. In some examples, the shield 218 can be positioned between the input tray 204 can the first user interface 208. In some examples, the shield 218 can prevent objects or debris from entering the printing path at the input tray 204. In some examples, the utilization of the first user interface 208 can increase the potential for objects or debris to be unintentionally positioned within the printing path, which can cause damage to the printing device 200. In some examples, the shield 218 can be positioned substantially parallel with the input tray 204. In some examples, the shield 218 can comprise a particular material to enable a user to view the input to the printing path. For example, the shield 218 can comprise a transparent or semi-transparent material (e.g., transparent polymer, semi-transparent polymer, etc.).

The printing device 200 can provide a plurality of services (e.g., printing and audio playback, etc.) within a single footprint. In addition, the printing device 200 can also provide charging and other functionality to remote devices utilizing the plurality of services.

Figure 3:
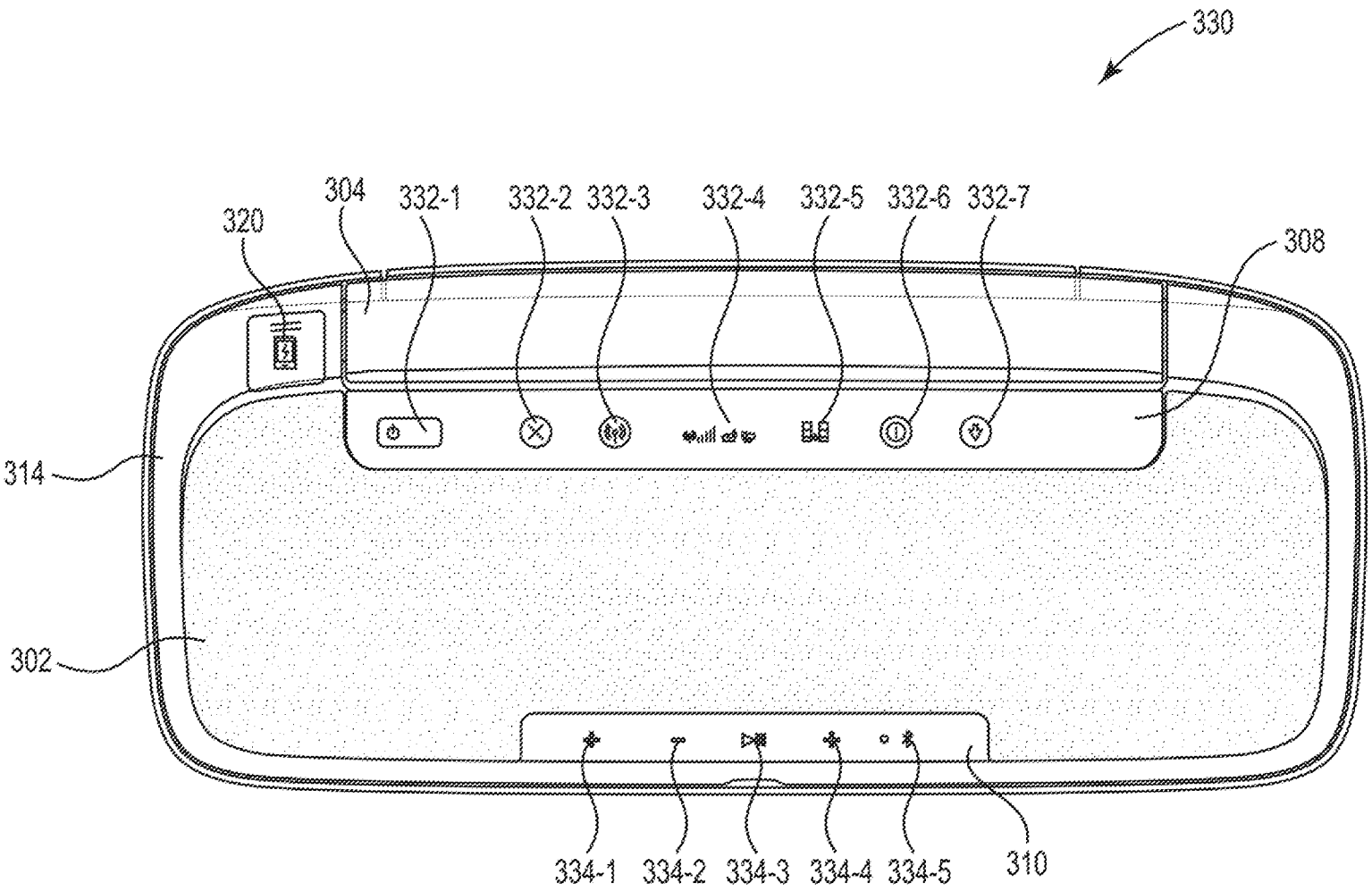
FIG. 3 illustrates an example of a printing device and speaker system consistent with the present disclosure.

FIG. 3 illustrates an example of a printing device and speaker system 330 consistent with the present disclosure. In some examples, the system 330 can be a top view of the printing device 100 as referenced in FIG. 1 and/or a top view of the printing device 200 as referenced in FIG. 2. In some examples, the system 330 can include a printing device positioned below a speaker 302. As described herein, the speaker 302 can be a wireless speaker that can communicate via a wireless connection with mobile computing devices and/or remote computing devices.

As described herein, the speaker 302 can be coupled to the printing device within a recessed portion 314 of the printing device. In addition, the speaker 302 can be coupled between an input tray 304 and an output tray (not shown) of the printing device. In some examples, the speaker 302 can include a first user interface 308 and a second user interface 310. As described herein, the first user interface 308 can be positioned between the speaker 302 and the input tray 304. In addition, the second user interface 310 can be positioned between the speaker 302 and an output tray of the printing device. In some examples, the first user interface 308 and the second user interface 310 can be co-planer. For example, the first user interface 308 and the second user interface 310 can be within the same plane. In some examples, the first user interface 308 and the second user interface 310 can be substantially parallel.

In some examples, the system 330 can include a charging port 320. As described herein, the charging port 320 can be a USB charging port that can be utilized exclusively for providing electrical power to a connected device. In some examples, the charging port 320 can be positioned within the recessed portion 314 of the computing device. In some examples, the charging port 320 can include a dust cover or door that can protect the charging port 220 when it is not in use.

In some examples, the speaker 302 can include a first enclosure to enclose the speaker portion of the speaker 302, a second enclosure to enclose the first user interface, and a third enclosure to enclose the second user interface 310. In some examples, the first enclosure can comprise a first material, the second enclosure can comprise a second material, and the third enclosure can comprise a third material. For example, the first material can be a metallic material to cover the speaker portion of the speaker 302, the second material can be a first type of polymer material, and the third material can be a second type of polymer material.

In some examples, the first user interface 308 can be communicatively coupled to the printing device to provide inputs and/or notifications corresponding to the printing device. In some examples, the first user interface 308 can be exclusively connected to the printing device. For example, the first user interface 308 may not be communicatively coupled to the speaker 302. In some examples, the first user interface can include a plurality of elements 332-1, 332-2, 332-3, 332-4, 332-5, 332-6, 332-7, hereinafter referred to as elements 332. FIG. 3 illustrates seven elements, but the first user interface 308 is not limited to seven elements. For example, the first user interface 308 can include additional or fewer elements. As used herein, the elements 332 can include inputs and/or notifications as described herein.

In some examples, the elements 332 can include a power element 332-1. The power element can include a button for activating and/or deactivating the printing device. For example, pressing the power element 332-1 a first time can turn on the printing device and pressing the power element 332-1 a second time can turn off the printing device. In some examples, the elements 332 can include a paper stop element 332-2. The stop element 332-2 can be an input that can be utilized to stop or cancel a print job.

In some examples, the elements 332 can include a wireless element 332-3. In some examples, the wireless element 332-3 can notify a user that wireless capabilities of the printing device is activated or deactivated. For example, the printing device can include a wireless module to connect to a network (e.g., local area network, wide area network, internet, etc.) and/or computing device. In this example, the wireless element 332-3 can notify a user that the wireless module is activated and/or deactivated. In some examples, the elements 332 can include a network element 332-4. The network element can be a notification element that indicates when the printing device is connected to a network or computing device.

In some examples, the elements 332 can include an ink level element 332-5. In some examples, the ink level element 332-5 can be a notification element to notify a user of a level of ink or toner available for the printing device. In some example, the elements 332 can include a status indicator element 332-6. In some examples, the status indicator element 332-6 can be a notification element that can notify a user when a paper jam or other malfunction has occurred during a print job. In some examples, the elements 332 can include a paper feed element 332-7. The paper feed element 332-7 can be an input for feeding a sheet of paper past the print zone and into the output tray of the printing device.

In some examples, the second user interface 310 can include a plurality of elements 334-1, 334-2, 334-3, 334-4, 334-5, hereinafter referred to as elements 334. FIG. 3 illustrates five elements, but the second user interface 310 is not limited to five elements. For example, the second user interface 310 can include additional or fewer elements. As used herein, the elements 334 can include inputs and/or notifications as described herein.

In some examples, the elements 334 can include a telephone element 334-1. In some examples, the telephone element 334-1 can be an input element that can be selected (e.g., pressed) to initiate a telephone call via a mobile computing device or remote computing device. In some examples, the elements 334 can include a decrease volume element 334-2. The decrease volume element 334-2 can be an input element that can be selected to decrease volume of the speaker 302. In some examples, the elements 334 can include a play/pause element 343-3. The play/pause element 343-3 can be selected to play and/or pause an audio file.

In some examples, the elements 334 can include an increase volume element 334-4. In some examples, the increase volume element 334-4 can be an input element that can be selected (e.g., pressed) to increase a volume of the speaker 302. In some examples, the elements 334 can include a wireless connection element 334-5. The wireless connection element 334-5 can be an input and/or notification of a wireless connection to a mobile computing device and/or a remote device. For example, the wireless connection element 334-5 can be selected to initiate a communication session with a mobile computing device. In some examples, the wireless connection element 334-5 can be a notification element that can notify a user when a wireless connection is established with a mobile computing device or remote computing device as described herein.

Figure 4:
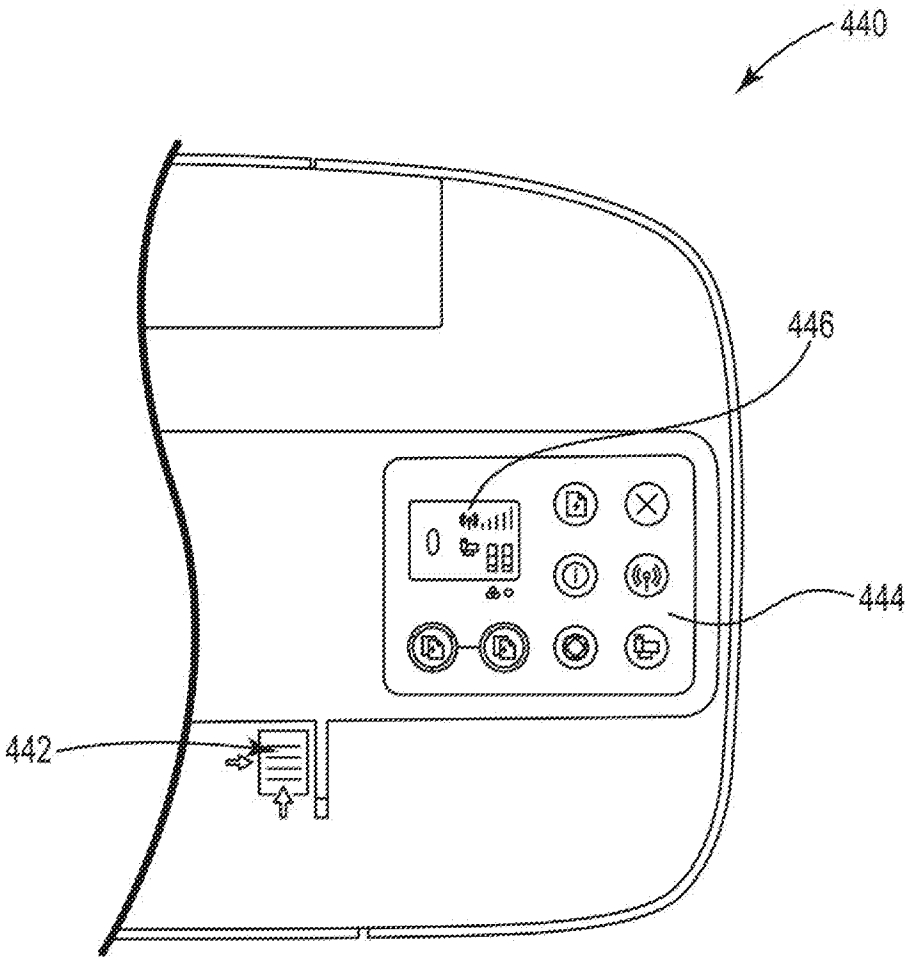
FIG. 4 illustrates an example of a user interface consistent with the present disclosure.

FIG. 4 illustrates an example of a user interface 440 consistent with the present disclosure. In some examples, the user interface 440 can be a third user interface for the printing device. For example, the printing device can include the user interface 440 near a rear position of the printing device. For example, the user interface 440 can be positioned at an opposite end of the printing device compared to the output tray (e.g., output tray 106 as referenced in FIG. 1, etc.).

In some examples, the user interface 440 can include a charging port 442. As described herein, the charging port 442 can be utilized to provide electrical energy to a remote device. In some examples, the charging port 442 can be a USB port that can provide electrical energy to the remote device via wired connection. In some examples, the charging port 442 can disable communication between the remote device and the printing device or speaker as described herein.

In some examples, the user interface 440 can include a plurality of elements 444 to execute a plurality of corresponding functions of the printing device. For example, the plurality of elements 444 can include, but are not limited to, the elements 332 of the first user interface 308 as referenced in FIG. 3. In some examples, the user interface 440 can include a display 446. The display 446 can include a number of notifications as described herein. For example, the display 446 can be a digital display to notify a user of a network connection, an ink level, and/or a quantity of print jobs performed by the printing device.

The above specification, examples and data provide a description of the method and applications, and use of the system and method of the present disclosure. Since many examples can be made without departing from the spirit and scope of the system and method of the present disclosure, this specification merely sets forth some of the many possible example configurations and implementations.

The invention claimed is:

1. A printing device, comprising:

an enclosure comprising a first material to enclose a print zone of the printing device;

a recessed portion comprising a second material positioned on a surface of the enclosure;

a wireless speaker coupled to a portion within the recessed portion between a load tray and an output tray, wherein the wireless speaker is separate from the enclosure of the printing device;

a first user interface positioned on a first edge of the wireless speaker separate from the enclosure of the printing device to receive inputs for the printing device; and a second user interface positioned on a second edge of the wireless speaker separate from the enclosure of the printing device to receive inputs for the wireless speaker.

2. The printing device of claim 1, wherein the wireless speaker, the first user interface, and the second user interface are positioned on a single plane of the printing device.

3. The printing device of claim 1, wherein the first user interface is directly coupled to the first edge of the wireless speaker separate from the enclosure of the printing device and the second user interface is directly coupled to the second edge of the wireless speaker separate from the enclosure of the printing device.

4. The printing device of claim 1, wherein the wireless speaker extends from a first end to a second end of the printing device.

5. The printing device of claim 1, comprising a charging port for a remote device that is positioned between the wireless speaker and an edge of the recessed portion.

6. A system, comprising:

a printing device comprising:

an enclosure comprising a first material to enclose a print zone of the printing device;

an exterior media load tray coupled to a first edge of the enclosure and an exterior media output tray coupled to a second edge of the enclosure; and a recessed portion comprising a second material positioned on a top surface of the enclosure, wherein the recessed portion extends from the first edge to the second edge of the top surface of the enclosure;

a wireless speaker coupled to the recessed portion of the printing device between the exterior media load tray and the exterior media output tray, wherein the wireless speaker is separate from the enclosure of the printing device;

a first user interface coupled to a first edge of the wireless speaker separate from the enclosure of the printing device, wherein the first user interface is communicatively coupled to the printing device to alter settings of the printing device; and a second user interface coupled to a second edge of the wireless speaker separate from the enclosure of the printing device, wherein the second user interface is communicatively coupled to the wireless speaker to alter settings of the wireless speaker and initiate communication with a remote computing device.

7. The system of claim 6, comprising a space between an edge of the recessed portion and the wireless speaker.

8. The system of claim 6, wherein wireless speaker is positioned within a footprint of the printing device.

9. The system of claim 6, wherein the second user interface is communicatively coupled to the wireless speaker to initiate a telephone call via the remote computing device.

10. The system of claim 9, wherein the wireless speaker is utilized as a speaker and a microphone for the remote computing device during the telephone call.

11. The system of claim 6, wherein the first user interface is communicatively coupled to the printing device to display notifications from the printing device.

12. A printing device, comprising:

an enclosure of the printing device comprising a first material with a top portion that includes a recessed portion comprising a second material;

a media load tray coupled to a first side of the enclosure and on a first side of the recessed portion;

a media output tray coupled to a second side of the enclosure and on a second side of the recessed portion;

a wireless speaker coupled within the recessed portion of the printing device such that a space exists between an edge of the recessed portion and the wireless speaker, wherein the wireless speaker is separate from the enclosure of the printing device;

a first user interface coupled to the wireless speaker between the media load tray and the wireless speaker such that a space exists between the first user interface and the edge of the recessed portion, wherein the first user interface is communicatively coupled to the printing device to display information relating to the printing device; and a second user interface coupled to the wireless speaker between the media output tray and the wireless speaker such that a space exists between the second user interface and the edge of the recessed portion, wherein the second user interface is communicatively coupled to the wireless speaker to:

alter settings of the wireless speaker;

initiate a wireless connection with a mobile computing device; and alter settings of the mobile computing device.

13. The printing device of claim 12, wherein the first user interface is directly coupled to the wireless speaker and separate from the recessed portion and enclosure of the printing device.

14. The printing device of claim 13, wherein the second user interface is directly coupled to the wireless speaker and separate from the recessed portion and enclosure of the printing device.

15. The printing device of claim 12, comprising a third user interface that is coupled to the enclosure of the printing device, wherein the third user interface includes a plurality of elements that are included on the first user interface.

* * * * *